US011421860B2

(12) United States Patent
Guerra et al.

(10) Patent No.: US 11,421,860 B2
(45) Date of Patent: Aug. 23, 2022

(54) OPTIC SUPPORT FOR A LIGHT FIXTURE

(71) Applicant: Hubbell Lighting, Inc., Shelton, CT (US)

(72) Inventors: George Guerra, Chino Hills, CA (US); Kevin Lu, Fountain Valley, CA (US); Syed Raza, Rancho Palos Verdes, CA (US); Dean Dal Ponte, Glendale, CA (US)

(73) Assignee: Hubbell Lighting, Inc., Shelton, CT (US)

( * ) Notice: Subject to any disclaimer, the term of this patent is extended or adjusted under 35 U.S.C. 154(b) by 0 days.

(21) Appl. No.: 16/204,700

(22) Filed: Nov. 29, 2018

(65) Prior Publication Data

US 2019/0162392 A1 May 30, 2019

Related U.S. Application Data

(60) Provisional application No. 62/592,892, filed on Nov. 30, 2017.

(51) Int. Cl.

| | |
|---|---|
| ***F21V 19/00*** | (2006.01) |
| ***F21S 8/02*** | (2006.01) |
| ***F21V 31/00*** | (2006.01) |
| ***F21V 3/00*** | (2015.01) |
| ***F21V 17/16*** | (2006.01) |
| ***F21V 15/01*** | (2006.01) |
| *F21Y 103/10* | (2016.01) |
| *F21Y 115/10* | (2016.01) |

(52) U.S. Cl.

CPC ..... *F21V 19/0015* (2013.01); *F21S 8/024* (2013.01); *F21V 3/00* (2013.01); *F21V 15/013* (2013.01); *F21V 17/164* (2013.01); *F21V 31/005* (2013.01); *F21Y 2103/10* (2016.08); *F21Y 2115/10* (2016.08)

(58) Field of Classification Search

CPC ..... F21V 19/0015; F21V 19/004; F21V 3/00; F21V 15/013; F21V 17/164; F21V 31/005; F21S 8/024

See application file for complete search history.

(56) References Cited

U.S. PATENT DOCUMENTS

| | | | | |
|---|---|---|---|---|
| 4,410,931 | A * | 10/1983 | DeCandia | F21V 17/164 362/306 |
| D295,086 | S | 4/1988 | Morten | |
| D397,818 | S | 9/1998 | Herst | |
| D502,565 | S | 3/2005 | Hetfield | |
| D580,583 | S | 11/2008 | Pfund | |
| D603,548 | S | 11/2009 | Pei | |
| D610,293 | S | 2/2010 | Klaus | |
| D624,229 | S | 9/2010 | Adolph | |
| D629,554 | S | 12/2010 | Gielen | |

(Continued)

*Primary Examiner* — Rajarshi Chakraborty
*Assistant Examiner* — Nathaniel J Lee
(74) *Attorney, Agent, or Firm* — Michael Best & Friedrich LLP

(57) ABSTRACT

An optic support is provided for a light fixture having a light engine secured within a housing. The optic support includes a body and a biasing member. The body includes a first portion and a second portion. The second portion is configured to engage an optic. The biasing member is coupled to the first portion of the body. The biasing member is configured to bias the body into engagement with the housing.

18 Claims, 7 Drawing Sheets

(56) References Cited

U.S. PATENT DOCUMENTS

| | | | | |
|---|---|---|---|---|
| D727,551 | S | 4/2015 | Clark | |
| 8,998,480 | B2 * | 4/2015 | Dellian | F21V 19/004 362/656 |
| D735,392 | S | 7/2015 | Ng | |
| D756,553 | S | 5/2016 | Kim | |
| D766,487 | S | 9/2016 | Cai | |
| D775,395 | S | 12/2016 | Huyghe | |
| D791,998 | S | 7/2017 | Lonsdale | |
| D794,241 | S | 8/2017 | Huyghe | |
| D808,566 | S | 1/2018 | Goetz-Schaefer | |
| D825,815 | S | 8/2018 | Sonneman | |
| D847,395 | S | 4/2019 | Tremaine | |
| 2011/0080746 | A1 * | 4/2011 | Patti | F21V 15/013 362/370 |
| 2014/0233229 | A1 * | 8/2014 | Yaphe | F21V 3/00 362/235 |
| 2016/0178169 | A1 * | 6/2016 | Keser | H01R 33/0863 439/236 |

* cited by examiner

OPTIC SUPPORT FOR A LIGHT FIXTURE

CROSS-REFERENCE TO RELATED APPLICATION

This application claims the benefit of prior-filed U.S. Provisional Patent Application No. 62/592,892, filed Nov. 30, 2017, the entire contents of which are incorporated by reference.

BACKGROUND

The present disclosure relates to an optic support, and more specifically to an optic support for a light fixture.

SUMMARY

In one independent aspect, an optic support is provided for a light fixture having a light engine secured within a housing. The optic support includes a body and a biasing member. The body includes a first portion and a second portion. The second portion is configured to engage an optic. The biasing member is coupled to the first portion of the body. The biasing member is configured to bias the body into engagement with the housing.

In another independent aspect, a light fixture includes a housing, a light engine coupled to the housing, a lens, a support, and a biasing member. The light engine includes at least one light-emitting element. The lens is positioned proximate the light-emitting element. The support is coupled to the housing and supports the lens. The biasing member releasably couples the support to the housing.

In yet another independent aspect, light fixture includes a housing, a light engine, a lens, a first support, a first leaf spring, a second support, and a second leaf spring. The housing includes a first inner surface and a second inner surface facing toward the first inner surface. The light engine is coupled to the housing and positioned between the inner surfaces. The light engine includes at least one light-emitting element. The lens is positioned proximate the light-emitting element. The first support is coupled to the first inner surface of the housing and supports the lens. The first leaf spring releasably couples the first support to the housing. The first leaf spring includes a first end, a second end, and a convex portion positioned between the first end and the second end. The convex portion engages a groove on the first inner surface. The second support is coupled to the second inner surface of the housing and supports the lens. The second leaf spring releasably couples the second support to the housing. The spring leaf spring includes a first end, a second end, and a convex portion positioned between the first end and the second end. The convex portion engages a groove on the second inner surface.

Other aspects of the disclosure will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In general, the present disclosure relates to a support for coupling an optic, such as a lens, to a light fixture housing. The support is coupled to the housing by a biasing member, and the support retains the optic against a seal.

Figure 1:
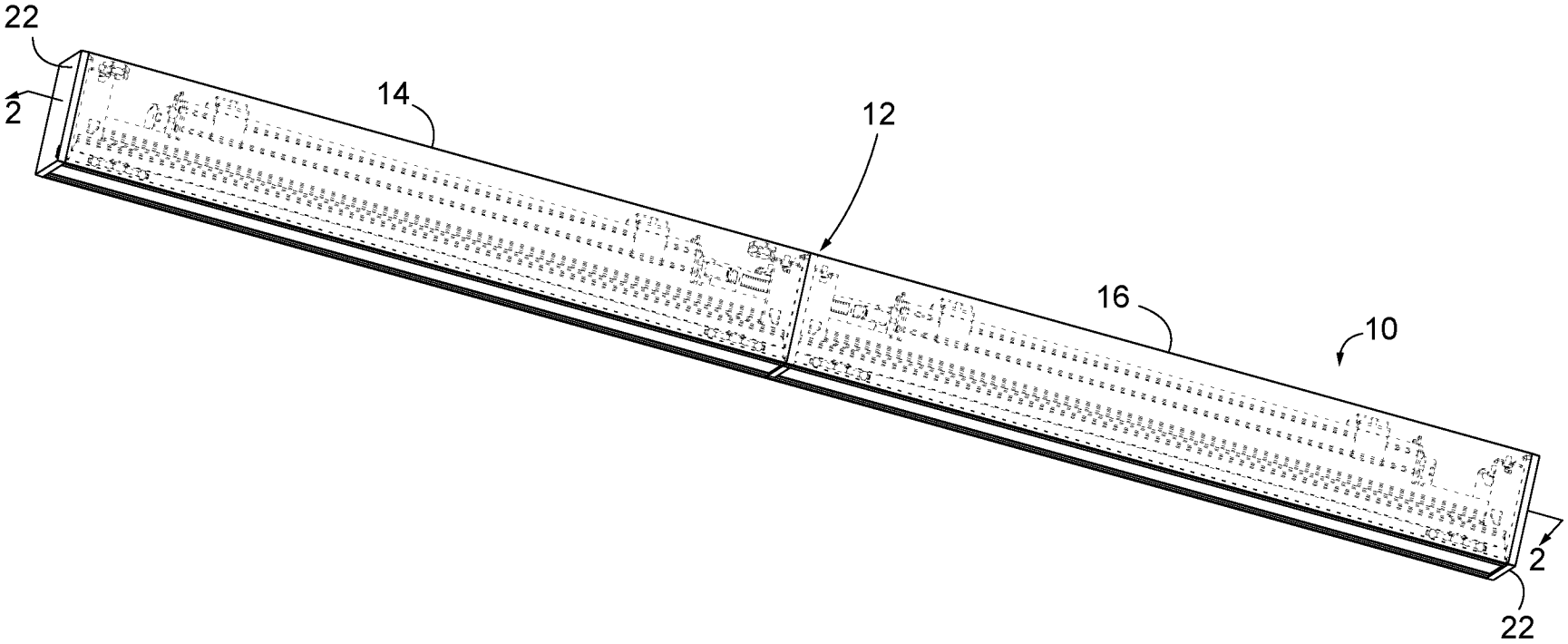
FIG. 1 is a perspective view of a luminaire.
Figure 2:
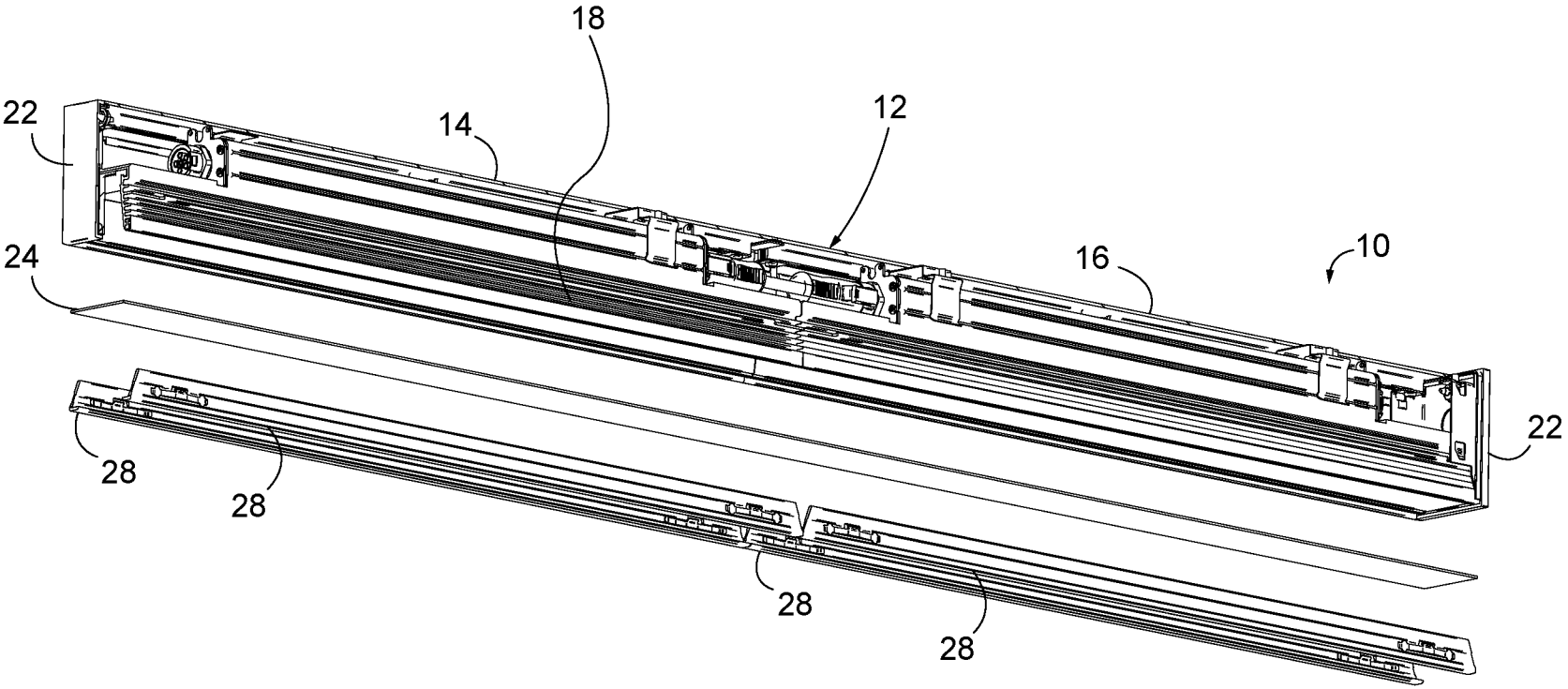
FIG. 2 is perspective partially exploded view of the luminaire of FIG. 1.

As shown in FIGS. 1 and 2, a luminaire 10 includes a housing 12 and a light engine 18. In the illustrated embodiment, the housing 12 includes a first housing portion 14 and a second housing portion 16. The first housing portion 14 is coupled to the second housing portion 16 to form a housing length. In the illustrated embodiment, the housing portions 14, 16 have an elongated, rectangular profile, although in other embodiments, the housing portions 14, 16 may have a differently shaped profile. In the illustrated embodiment, each housing portion 14, 16 includes a light engine 18. The light engines 18 are coupled together and extend along the length of the housing 12. An end cap 22 is coupled to a side of each of the housings 14, 16.

Figure 3:
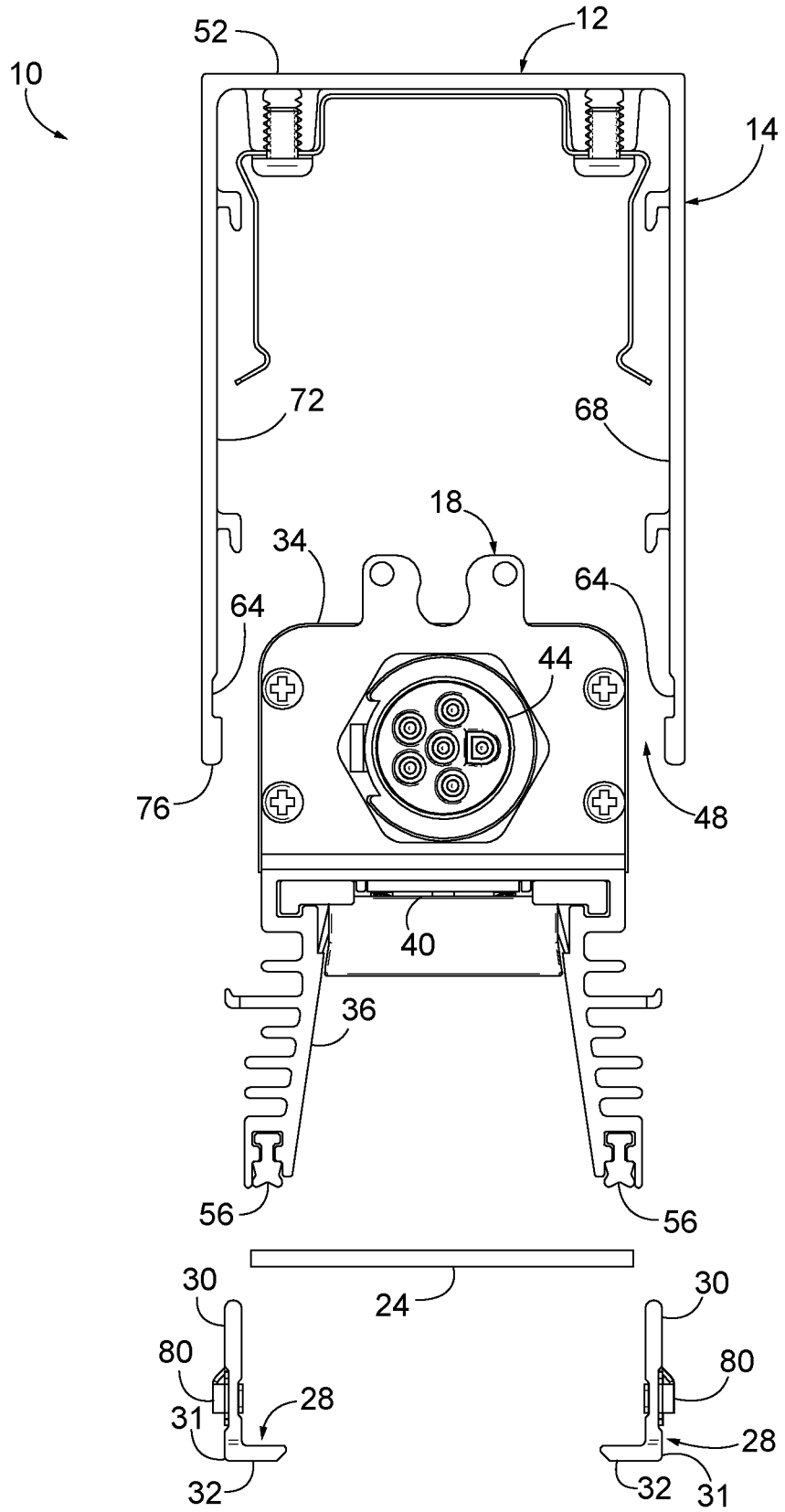
FIG. 3 is an exploded end view of the luminaire of FIG. 1.

As shown in FIG. 2, an optic 24 is positioned on one side of the housing 12. In the illustrated embodiment, the optic 24 is a lens 24 and is coupled to the bottom of the housing portions 14, 16 by supports 28. In the illustrated embodiment, the lens 24 has a length substantially equivalent to the housing length, although in other embodiments, the lens 24 may have a different length. In the illustrated embodiment, four supports 28 couple the lens 24 to the housing portions 14, 16, although in other embodiments, the luminaire 10 may include a different number of supports 28. In the illustrated embodiment, the profile of the support 28 has an L-shape. Each support 28 includes a body having a first portion 30 and a second portion 32 (FIG. 3). Each support 28 is formed as a single piece.

Figure 4:
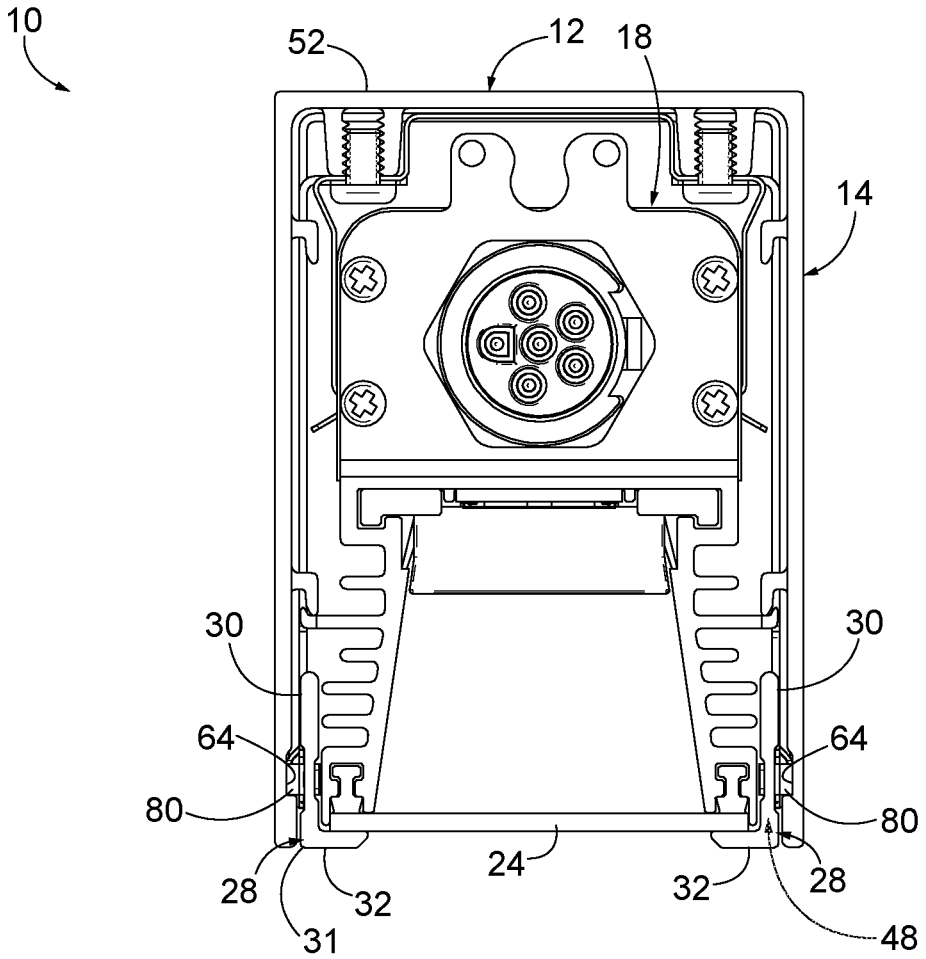
FIG. 4 is a partially exploded end view of the luminaire of FIG. 1.

As shown in FIGS. 3 and 4, each light engine 18 includes a body 34, a heat sink 36, a light emitter 40, and an electrical connector 44. The body 34 is positioned within an interior 48 and proximate an upper surface 52 of the housing portions 14, 16. The heat sink 36 is coupled to the body 34. Also, in the illustrated embodiment, gaskets 56 are positioned adjacent an end of the light engine 18 proximate the lens 24.

The body 34 further includes drivers (not shown) for supplying and controlling current to the light emitter 40. The light emitter 40 is positioned on the body 34 and surrounded by the heat sink 36. In the illustrated embodiment, the light emitter 40 is a light emitting diode or LED, although in other embodiments, the light emitter 40 may be another type of light emitter. The electrical connector(s) 44 is positioned on an end of each body 34. The electrical connector 44 on an end of one of the housing portions 14, 16 can be in electrical communication with an electrical connector 44 on an end of the other of the housing portions 14, 16. The electrical connectors 44 provide electrical communication between separate light engines 18.

In the illustrated embodiment, each housing portion 14, 16 includes a first internal or side surface 68 and a second internal or side surface 72. The first internal surface 68 and the second internal surface 72 each have an internal ledge 64. Each internal ledge 64 is positioned proximate a lower end 76 of the housing 14, 16 proximate the lens 24. In some embodiments, the internal ledges 64 extend the length of the housing 12.

Referring again to FIGS. 3 and 4, the first portion 30 and the second portion 32 of the support 28 are oriented at a right angle, and a bend 31 is disposed between the first portion 30 and the second portion 32. Although in other embodiments, the first portion 30 and the second portion 32 may not be formed at a right angle. The first portion 30 of each support 28 is oriented substantially parallel to one of the side surfaces 68, 72, while the second portion 32 of each support 28 is oriented toward a center of the housing portions 14, 16 (that is, toward the other support 28). A biasing member or spring 80 is coupled to the first portion 30 of the support 28 and positioned on an opposite side from the direction in which the second portion 32 extends.

Figure 5:
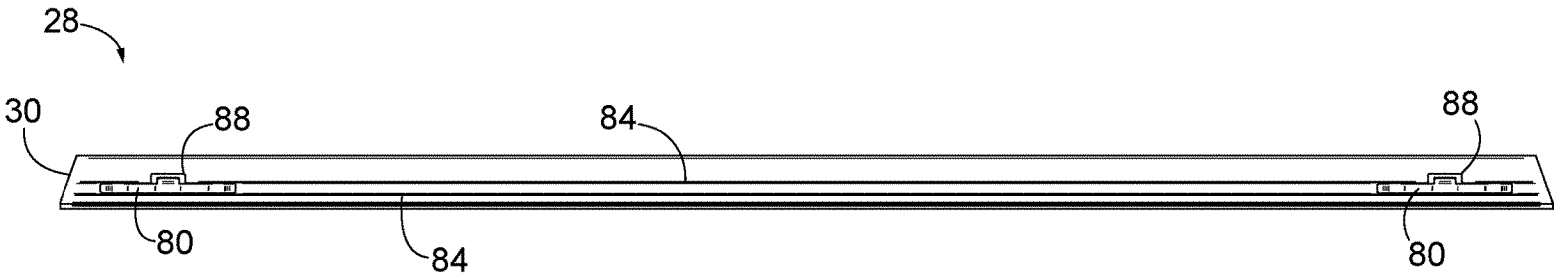
FIG. 5 is a side view of an optic support.
Figure 6:
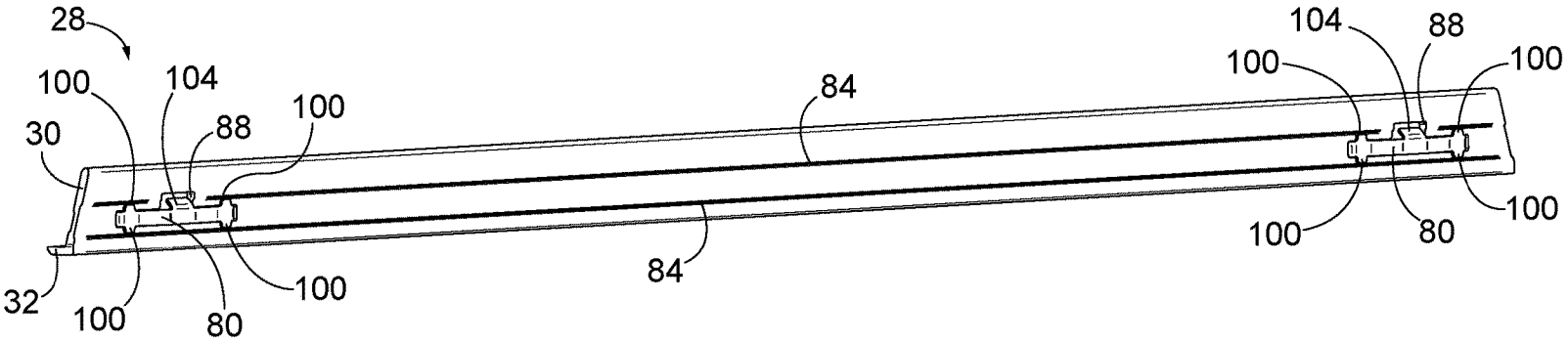
FIG. 6 is a perspective view of an optic support of FIG. 5.

As shown in FIGS. 5 and 6, each support 28 includes a pair of parallel rails 84. The parallel rails 84 are positioned on the opposite side of the first portion 30 of the support 28, opposite the direction in which the second portion 32 extends. In some embodiments, the rails 84 extend along the length of each support 28. Each support 28 also includes apertures 88. In the illustrated embodiment, each support 28 has two apertures 88, although in other embodiments, each support 28 may have fewer or more apertures 88. One aperture 88 is positioned proximate each end of the support 28 and the apertures 88 intersect one of the parallel rails 84.

Figure 8:
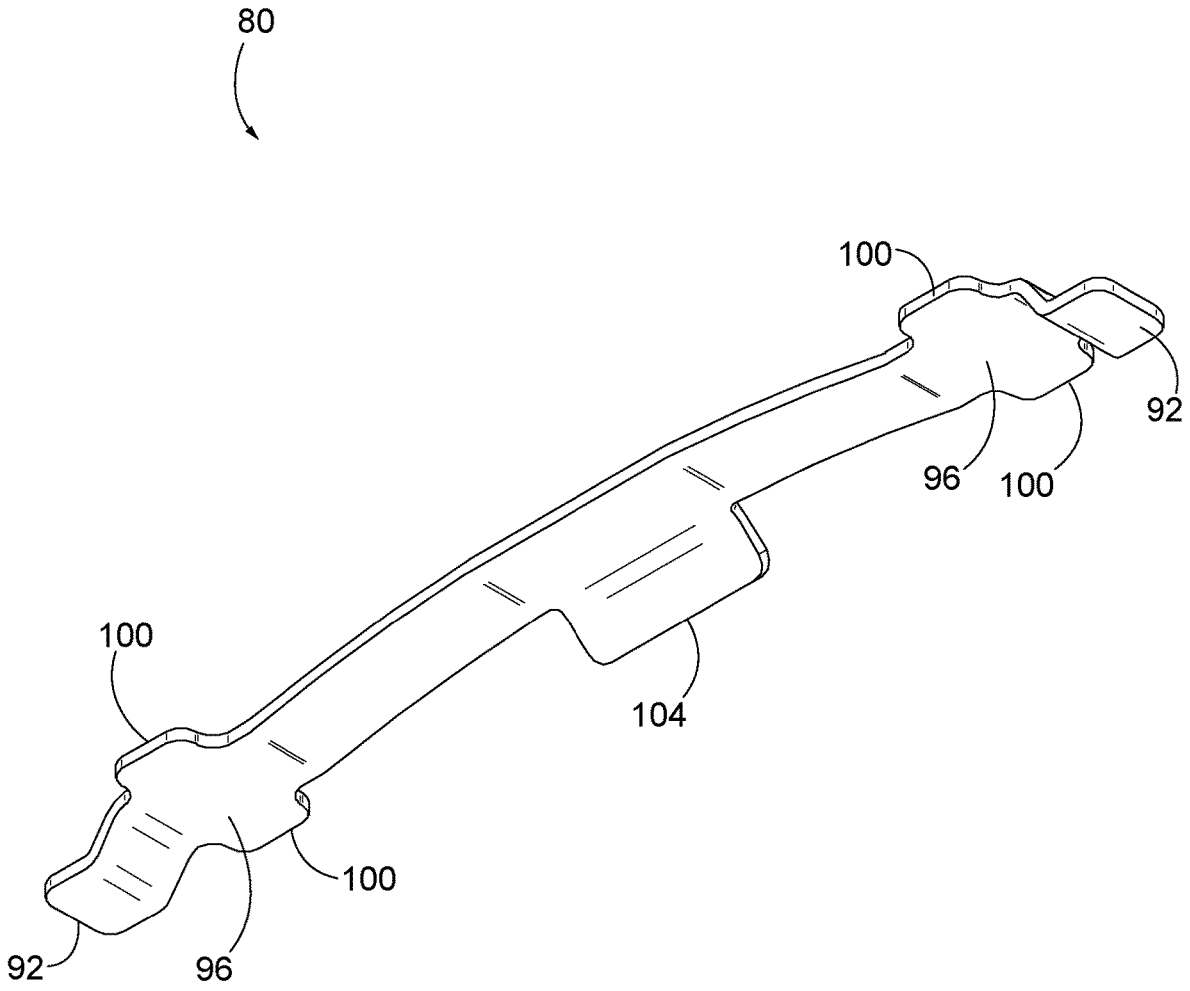
FIG. 8 is a perspective view of the biasing member of FIG. 7.

As shown in FIG. 8, the spring 80 has an elongated, curved profile. In the illustrated embodiment, the spring 80 is a leaf spring, although in other embodiments, the spring 80 may be another type of spring. A tab 92 is positioned adjacent each end of the spring 80. Each tab 92 is flat and the spring 80 curves from one tab 92 towards the other tab 92. Proximate each tab 92 is a flange 96 with two projections 100. Each projection 100 extends away from the spring 80 in a direction orthogonal to the tabs 92. In the illustrated embodiment, the protrusion 104 is oriented at an oblique angle relative to a center portion of the spring 80 and positioned at the center of the spring 80. In addition, the protrusion 104 is oriented obliquely and inwardly, away from an inner surface of the housing 12.

Figure 7:
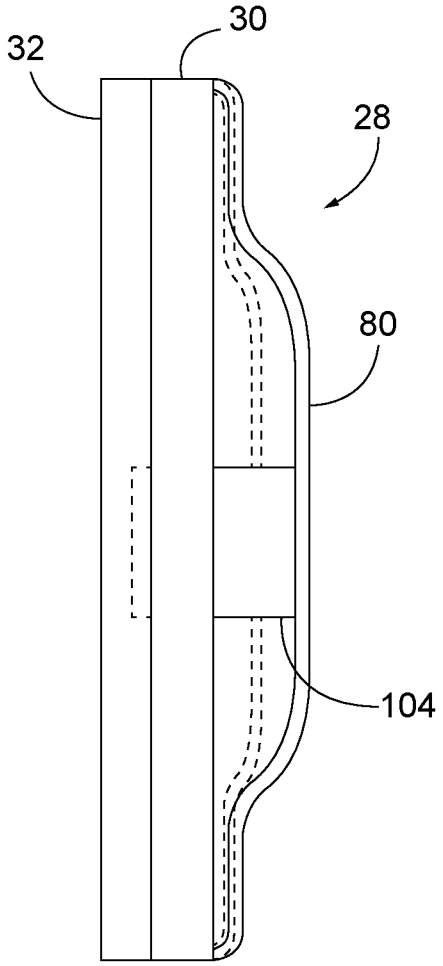
FIG. 7 is enlarged plan view of a portion of the optic support of FIG. 5, illustrating a biasing member.

Referring again to FIGS. 5 and 6, each projection 100 is positioned between one of the rails 84 and the surface of the second portion 32, thereby coupling the spring 80 to the support 28. Additionally, the protrusion 104 is aligned with one of the apertures 88. The tabs 92 abut the surface of the support 28. As shown in FIG. 7, the spring 80 is movable between a first or relaxed state (solid lines) and a second or deformed state (broken lines). In the relaxed state, the protrusion 104 may be aligned with but spaced apart from the aperture 88 (FIG. 5), while the protrusion 104 may extend at least partially through the aperture 88 in the deformed state. The spring 80 is biased toward the relaxed position.

Referring again to FIG. 4, the supports 28 hold and retain the lens 24 with respect to the housing 12 by pressing the lens 24 against the gaskets 56. During assembly, the first portion 30 of each support 28 is moved into a space between the heat sink 36 and one of the internal surfaces 68, 72. As the first portion 30 is inserted, an outer surface of the protrusion 104 may contact an internal surface 68, 72 of the housing 12, elastically deflecting (e.g., compressing) the spring member 80. When deflected, the protrusion 104 may extend at least partially into the aperture 88 (FIG. 6) to provide additional clearance (FIG. 7). Once the support 28 is inserted so that the spring 80 is clear of the internal ledge 64, the spring 80 relaxes and extends outwardly to engage the internal ledge 64. The spring 80 is biased towards the corresponding internal surface 68, 72 and will not be extracted until the spring 80 is compressed. The spring 80 is substantially the same size as the internal ledge 64 and prevents the support 28 from moving relative to the housing 12 while the spring is received on the internal ledge 64 in the relaxed state. The supports 28 press the lens 24 against the gasket 56, sealingly engaging the lens 24 and the housing 12. The seal limits dust, water, and other particles from entering the interior 48 of the housing 12.

A tool (e.g., a thin, flat blade—not shown) may be inserted into the interior 48, proximate the first side surface 68 or the second side surface 72, while the supports 28 and lens 24 are coupled to the housing portions 14, 16. The blade may bias either surface 68, 72 outwards (i.e., away from the light engine 18) and/or compress the spring 80, thereby spacing the spring 80 from the internal ledge 64 and providing clearance for the supports 28 and lens 24 to be removed from the housing 12 and providing access to the light engine 18.

Although aspects have been described in detail with reference to certain preferred embodiments, variations and modifications exist within the scope and spirit of one or more independent aspects as described.

What is claimed is:

1. An optic support for a light fixture, the light fixture including a light engine secured within a housing, the optic support comprising:

a body including a first portion and a second portion, the first portion oriented in a direction substantially perpendicular with respect to the optic, the second portion configured to engage a lower surface of an optic;

a biasing member including a first end, a second end and an intermediate portion having an arcuate, convex shape extending from the first end to the second end, the first end coupled to the first portion of the body, the second end coupled to the first portion of the body, the biasing member configured to bias the body into engagement with the housing, the biasing member movable between a relaxed state and a deflected state;

an opening positioned on one of the body and the biasing member; and a protrusion positioned on the other of the body and the biasing member, the protrusion aligned with the opening, movement of the biasing member between the relaxed state and the deflected state causing the protrusion to alternately extend into the opening and retract from the opening.

2. The optic support of claim 1, wherein the first portion is orthogonal to the second portion.

3. The optic support of claim 1, wherein the convex shape protrudes away from the first portion of the body.

4. The optic support of claim 1, wherein the body is configured to be secured between the light engine and the housing, the biasing member configured to engage an internal ledge of the housing in order to secure the body.

5. The optic support of claim 1, wherein the biasing member includes a plurality of tabs, the tabs secured between rails positioned on the body.

6. The optic support of claim 1, wherein the optic is a lens and the body includes a bend between the first portion and the second portion, the second portion including a surface configured to support the lens relative to the housing, the surface sealingly engaging the lens.

7. A light fixture comprising:

a housing;

a light engine coupled to the housing and including at least one light-emitting element;

a lens positioned proximate the light-emitting element;

a support coupled to the housing and supporting the lens, the support including a first portion and a second portion, the first portion positioned adjacent an inner surface of the housing, the second portion engaging a portion of an end face of the lens, light passing through the end face as it is emitted out of the housing;

a biasing member supported on one of the inner surface of the housing and the first portion of the support, the biasing member including a first end, a second end and an elongated intermediate portion having an arcuate, convex shape extending from the first end to the second end, the biasing member releasably coupling the support to the housing, the biasing member movable between a relaxed state and a deflected state;

an opening positioned on one of the biasing member and the one of the inner surface of the housing and the first portion of the support; and a protrusion positioned on the other of the biasing member and the one of the inner surface of the housing and the first portion of the support, the protrusion aligned with the opening, movement of the biasing member between the relaxed state and the deflected state causing the protrusion to alternately extend into the opening and retract from the opening.

8. The light fixture of claim 7, wherein the support is a first support, the luminaire further comprising a second support coupled to the housing and supporting the lens, the second support including a first portion and a second portion.

9. The light fixture of claim 7, wherein the first portion of the body is positioned between the light engine and housing.

10. The light fixture of claim 7, wherein the biasing member is a leaf spring, the leaf spring engaging the inner surface of the housing and retaining the support relative to the housing when the leaf spring is in a relaxed position.

11. The light fixture of claim 7, wherein the other of the inner surface of the housing and the first portion of the support includes an internal groove, the biasing member engaging the internal groove.

12. The light fixture of claim 7, further comprising a gasket supported adjacent an end of the light engine, the lens biased into sealing engagement with the gasket by the support.

13. The light fixture of claim 7, wherein the biasing member includes a plurality of tabs, the tabs secured between rails positioned on the body.

14. The light fixture of claim 7, wherein the support is a first support and the biasing member is a first biasing member coupling the first support to a first wall of the housing, the light fixture further comprising a second support supporting the lens, the second support including a first portion and a second portion, the second biasing member coupled to the second support for releasably coupling the second support to a second wall of the housing opposite the first wall.

15. The light fixture of claim 7, wherein the biasing member is a leaf spring including a first end, a second end, and a convex portion positioned between the first end and the second end, further including a protrusion connected to the convex portion and oriented inwardly away from an inner surface of the housing.

16. A light fixture comprising:

a housing including a first inner surface and a second inner surface facing toward the first inner surface;

a light engine coupled to the housing and positioned between the inner surfaces, the light engine including at least one light-emitting element;

a lens positioned proximate the light-emitting element;

a first support including a first surface facing the first inner surface of the housing and a second surface supporting the lens;

a first leaf spring releasably coupling the first support to the housing, the first leaf spring including a first end, a second end, and a convex portion extending from the first end to the second end, the convex portion extending between the first surface of the first support and the first inner surface of the housing, the convex portion engaging a groove, the first leaf spring movable between a relaxed state and a deflected state;

an opening positioned on one of the first leaf spring, the first support, and the housing;

a protrusion positioned on another of the first leaf spring, the first support, and the housing, the protrusion aligned with the opening, movement of the first leaf spring between the relaxed state and the deflected state causing the protrusion to alternately extend into the opening and retract from the opening;

a second support including a first surface facing the second inner surface of the housing and a second surface supporting the lens; and a second leaf spring releasably coupling the second support to the housing, the second leaf spring including a first end, a second end, and a convex portion extending from the first end to the second end, the convex portion extending between the first surface of the second support and the second inner surface of the housing, the convex portion of the second leaf spring engaging another groove.

17. The light fixture of claim 16, wherein the protrusion is connected to the convex portion and oriented inwardly away from the first inner surface, wherein the second leaf spring includes a second protrusion connected to the convex portion and oriented inwardly away from the second inner surface.

18. The light fixture of claim 16, wherein the first end and the second end of the first leaf spring are coupled to the first support, wherein the first end and the second end of the second leaf spring are coupled to the second support.

* * * * *